US010577692B2

(12) United States Patent
DiMilia et al.

(10) Patent No.: US 10,577,692 B2
(45) Date of Patent: Mar. 3, 2020

(54) PRETREATMENT OF IRON-BASED SUBSTRATES FOR ELECTROLESS PLATING

(71) Applicant: INTERNATIONAL BUSINESS MACHINES CORPORATION, Armonk, NY (US)

(72) Inventors: Doreen D. DiMilia, Pleasantville, NY (US); Yu Luo, Hopewell Junction, NY (US); Janusz J. Nowak, Highland Mills, NY (US); Lubomyr T. Romankiw, Briancliff Manor, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 52 days.

(21) Appl. No.: 15/398,809

(22) Filed: Jan. 5, 2017

(65) Prior Publication Data

US 2018/0187309 A1 Jul. 5, 2018

(51) Int. Cl.
*C23C 18/18* (2006.01)
*C23C 18/34* (2006.01)
(Continued)

(52) U.S. Cl.
CPC ..... *C23C 18/34* (2013.01); *C23C 18/168* (2013.01); *C23C 18/1637* (2013.01); *C23C 18/1844* (2013.01); *C23C 18/36* (2013.01)

(58) Field of Classification Search
CPC ..... C23C 18/1837; C23C 18/1637; C23C 18/168; C23C 18/34; C23C 18/1644; C23C 18/32; C23C 18/36; C23C 18/1844
See application file for complete search history.

(56) References Cited

U.S. PATENT DOCUMENTS 2,695,249 A * 11/1954 Sweo ..... C23D 3/00 427/376.5
2,748,066 A * 5/1956 Whitehouse ..... C23D 3/00 205/195

(Continued)

FOREIGN PATENT DOCUMENTS

GB 1 399 645 * 7/1975
JP 04-221079 * 8/1992
JP 08-170178 * 7/1996

OTHER PUBLICATIONS

Juan Hajdu, "Chapter 7: Surface Preparation for Electroless Nickel Plating", Electroless Plating—Fundamentals and Applications. 1990 William Andrew Publishing/Noyes from WWW.knovel.com. Electronic ISBN: 978-0-8155-1699-6. Feb. 4, 2002. pp. 193-206.

(Continued)

*Primary Examiner* — Katherine A Bareford

(74) *Attorney, Agent, or Firm* — Tutunjian & Bitetto, P.C.; Erik Johnson

(57) ABSTRACT

A method of electrolessly plating an iron-based substrate, including immersing an iron-based substrate in an acidic solution, immersing the iron-based substrate in a basic complexing solution, immersing the iron-based substrate in a catalytic metal solution including a catalytic metal, and immersing the iron-based substrate in an electroless nickel plating solution or an electroless cobalt plating solution.

19 Claims, 7 Drawing Sheets

(51) Int. Cl.
*C23C 18/36* (2006.01)
*C23C 18/16* (2006.01)

(56) References Cited

U.S. PATENT DOCUMENTS

| | | | | |
|---|---|---|---|---|
| 2,981,633 | A * | 4/1961 | Davis | C23D 3/00 134/41 |
| 4,171,393 | A | 10/1979 | Donley et al. | |
| 6,165,912 | A * | 12/2000 | McConnell | C23C 18/1831 257/E21.174 |
| 6,210,781 | B1 | 4/2001 | Baum et al. | |
| 7,851,357 | B2 | 12/2010 | Cabral, Jr. et al. | |
| 2002/0187895 | A1* | 12/2002 | Izaki | C23C 18/1889 502/330 |
| 2015/0044374 | A1 | 2/2015 | Janik et al. | |
| 2015/0110965 | A1* | 4/2015 | Brunner | C23C 18/34 427/430.1 |
| 2015/0159277 | A1* | 6/2015 | Wojcik | C23C 18/1651 427/343 |

OTHER PUBLICATIONS

Ron Parkinson, "Properties and applications of electroless nickel", Technical Series No. 10081. Nickel Development Institute.1997. pp. 1-33.

* cited by examiner

PRETREATMENT OF IRON-BASED SUBSTRATES FOR ELECTROLESS PLATING

BACKGROUND

Technical Field

The present invention generally relates to the removal of iron oxide from an iron surface, and more particularly to improvements in the adhesion of electroless nickel plating on iron-based surfaces.

Description of the Related Art

Nickel plating or electroless nickel plating can typically be used on metallic and non-metallic surfaces to provide improved surface properties to a material, which can include increased hardness, wear-resistance, and corrosion resistance. Nickel plating can also be used to provide particular electric and magnetic properties (e.g., ferromagnetic, non-magnetic) to a substrate.

Electroless plating is a chemical process typically involving an autocatalytic reaction between components of a plating solution and a material surface. An electroless process typically does not require the use of an electric current. Nickel plating can have different purity and structure (e.g., grain size, morphology/amorphousness, magnetic domain orientation, etc.) depending on whether the nickel plating is electrodeposited or electroless. Electroless nickel plating can contain notable amounts of phosphorus that can affect grain size, crystallinity, magnetic orientation, porosity, density, hardness, and corrosion resistance. Electroless nickel plating can provide more conformal plating with more uniform thickness compared to electrodeposited nickel. Electroless nickel plating with larger amounts of phosphorous can be amorphous. Electrodeposited nickel can be crystalline.

Surfaces typically require preparation to at least remove contaminants and activate the surface to be plated. While numerous cleaning and preparative methods are available for different surfaces, improved metal-to-metal bonding is desired.

SUMMARY

In accordance with an embodiment of the present invention, a method is provided for electrolessly plating an iron-based substrate. The method includes the step of immersing an iron-based substrate in an acidic solution. The method further includes the step of immersing the iron-based substrate in a basic complexing solution. The method further includes the step of immersing the iron-based substrate in a catalytic metal solution including a catalytic metal. The method further includes the step of immersing the iron-based substrate in an electroless nickel plating solution or an electroless cobalt plating solution.

In accordance with another embodiment of the present invention, a method is provided for nickel plating an iron-based substrate. The method includes the step of immersing an iron-based substrate in a 10% hydrochloric acidic solution. The method further includes the step of immersing the iron-based substrate subsequently in a sodium potassium tartrate ($KNaC_4H_4O_6$) or sodium citrate ($Na_3C_6H_5O_7$) solution with a pH in the range of about 7 to 9. The method further includes the step of immersing the iron-based substrate subsequently in a catalytic metal solution including dissolved $PdSO_4$ and a 10% sulfuric acid solution. The method further includes the step of immersing the iron-based substrate in an electroless nickel plating solution prepared using a nickel sulfate salt and sodium hypophosphite ($NaH_2PO_2$).

In accordance with yet another embodiment of the present invention, a method is provided for nickel plating an iron-based substrate. The method includes the step of immersing an iron-based substrate in a 10% hydrochloric acidic solution. The method further includes the step of immersing the iron-based substrate subsequently in a potassium sodium tartrate solution with a pH of about 8. The method further includes the step of immersing the iron-based substrate subsequently in a catalytic metal solution including about 25 ppm to about 75 ppm Pd from dissolved $PdSO_4$ and 10% sulfuric acid. The method further includes the step of immersing the iron-based substrate in an electroless nickel plating solution at a temperature in the range of about 20° C. to about 95° C., where the electroless nickel plating solution is prepared using a hydrated nickel sulfate salt ($NiSO_4$) and sodium hypophosphite ($NaH_2PO_2$), dimethylamine borane (DMAB), or sodium borohydride ($NaBH_4$).

These and other features and advantages will become apparent from the following detailed description of illustrative embodiments thereof, which is to be read in connection with the accompanying drawings.

BRIEF DESCRIPTION OF THE SEVERAL VIEWS OF THE DRAWINGS

The disclosure will provide details in the following description of preferred embodiments with reference to the following figures wherein.

DETAILED DESCRIPTION

Principles and embodiments of the present invention relate generally to removal of oxides from an iron-containing surface to provide an improved surface for electroless nickel plating.

Principles and embodiments of the present disclosure also relate generally to improving the adhesion of a nickel plating by maintaining an oxide-free surface after cleaning and during plating. An exposure of the substrate to an acidic solution followed by immersion in a buffered basic complexing solution can prevent reformation of oxides, and then a catalytic solution containing a catalytic metal to form a thin catalytic layer on the substrate can provide a bi-metallic surface layer of iron and the catalytic metal.

Principles and embodiments of the present disclosure also relate generally to forming a nickel plating with good adhesion without the use of a nickel strike.

Figure 1:
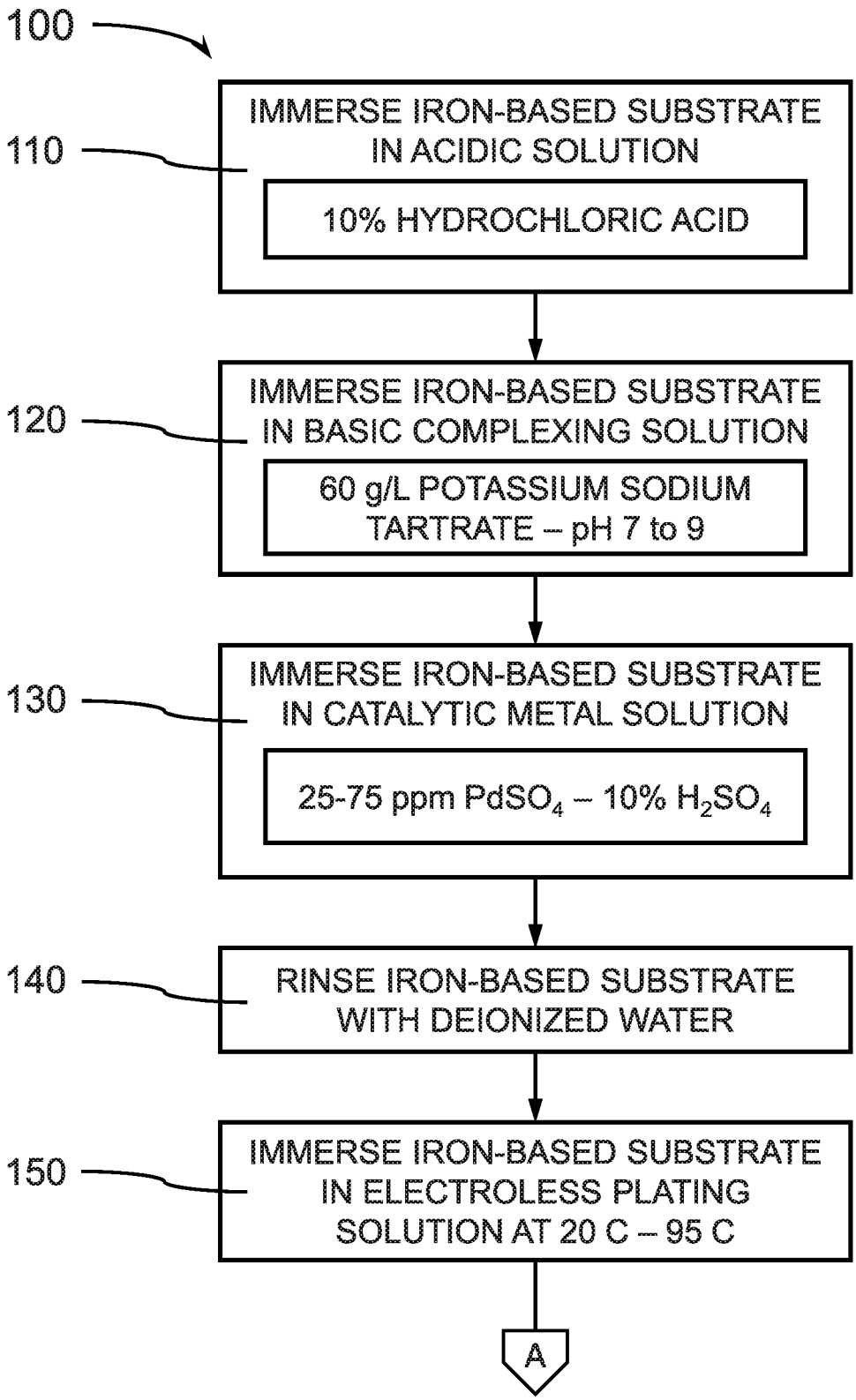
FIG. 1 is a block/flow diagram of a method of cleaning and plating an iron-based substrate, in accordance with an embodiment of the present invention.

Referring now to the drawings in which like numerals represent the same or similar elements and initially to FIG. 1, a block/flow diagram is shown for a method of cleaning and plating an iron-based substrate, in accordance with the present principles.

Principles and embodiments relate generally to a method 100 of preparing an iron-based substrate for electroless nickel plating that involves removing iron oxides (e.g., $Fe_2O_3$) and applying a catalytic metal to the surface without use of a nickel strike.

In one or more embodiments, a substrate that includes a majority of iron (i.e., at least 50.1% of the composition), such that the substrate is an iron-based substrate in contrast with a nickel-based material (e.g., Waspaloy®, Hastalloy®, Inconel, Alloy-20, etc.), a cobalt-based material (e.g., Stellite®, Haynes-188®, etc.), a high chromium alloy material (e.g., Kanthal®, austenitic stainless steels, etc.), or a high molybdenum alloy (e.g., TZM, SAE grade 41xx steel, etc.) can be cleaned and treated to form electroless nickel plating on the surface of the iron-based substrate. The iron-based substrate can be an iron-containing alloy that does not form a protective oxide coating of an alloyed metal, (e.g., austenitic stainless steels, SAE grade 41xx steel, etc.). The iron-based substrate can be cleaned to remove oxides and other contaminants (e.g., organics, metal ions, etc.) from the surface that can otherwise impair the formation of a quality nickel plating.

In various embodiments, the iron-based substrate may be carbon steels (e.g., SAE 1020, 1045, 1060, 1095, etc.) or low alloy steels (e.g., 13XX, 40XX, 92XX series steel, etc.) that do not form a protective oxide on the surface (e.g., 300 series or 400 series stainless steels), or a cast iron, In block 110, the iron-based substrate can be immersed in an acidic solution that can remove iron oxides from the surface of the substrate, as well as other metallic contaminants. In various embodiments, the acidic solution can be a hydrochloric acid solution, where the hydrochloric acid solution can have a concentration suitable for removing oxides from the substrate surface. The concentration of the hydrochloric acid solution can be in the range of about 5% to about 20% by weight, or in the range of about 8% to 15%, or about 10% by weight. The hydrochloric acid solution can remove iron oxides (e.g., $Fe_2O_3$) from the surface of the iron-based substrate. In various embodiments, the acid is not an oxidizing acid (e.g., $HNO_3$).

In one or more embodiments, the iron-based substrate can be immersed in the acidic solution for a period of about 5 minutes, or a time suitable to remove at least all of the iron oxides on the surface of the iron-based substrate.

In various embodiments, organic materials may be removed from the surface and pores of the iron-based substrate by a degreasing process, where organic solvents (e.g., alcohols, acetone, etc.) can be used for cleaning.

In block 120, the iron-based substrate can be immersed in a basic complexing solution (i.e., pH above 7) containing complexing agents to prevent reformation of oxides on the surface of the substrate, where the complexing agents can be sodium potassium tartrate ($KNaC_4H_4O_6$), sodium citrate ($Na_3C_6H_5O_7$), or combinations thereof, as well as similar complexing agents for iron (Fe) (e.g., oxylates (e.g., sodium oxylate ($Na_2C_2O_4$), etc.), ethylene-diamine-tetraacetic acid (EDTA), etc.). The pH of the basic solution can be in the range of 7 to about 9, or about 8. In various embodiments, the basic complexing solution can be a potassium sodium tartrate or sodium citrate solution to remove ferrous ions and chloride ions on the substrate. The potassium sodium tartrate or sodium citrate solution can have a pH of about 8. The pH of the potassium sodium tartrate or sodium citrate solution can be maintained in a range of 7 to about 9, or at a pH of about 8, by adding a 2 molar sodium hydroxide solution or a 10% hydrochloric acid solution to suitably adjust the pH up or down, where the basic complexing solution can prevent re-oxidation of the iron-based substrate. The citrate or tartrate can further act to buffer the solution at the predetermined pH. The substrate can be treated in a suitable tank or bath.

While not intending to be bound by theory, it is believed that the complexing agent binds with surface iron, such that the iron does not oxidize at the pHs of the solution. The surface iron complexes, thereby, protect the iron-based substrate from reoxidizing. The use of tartrate and/or citrate can provide an oxidation inhibiting coating on the iron-based substrate that is selective for the surface iron.

In various embodiments, the basic complexing solution can be prepared having a concentration in the range of about 30 g/L to about 100 g/L, or in the range of about 40 g/L to about 80 g/L, or about 60 grams of complexing agent per liter of water (e.g., 60 g/L $KNaC_4H_4O_6.4H_2O$, 60 g/L $Na_3C_6H_5O_7$, etc.).

The iron-based substrate can be immersed in the basic complexing solution for a duration of at least about 5 minutes. In various embodiments, the iron-based substrate can be immersed in the basic complexing solution for a duration of about 5 minutes to about 30 minutes, or about 5 minutes to about 10 minutes. The iron-based substrate can be immersed in the basic complexing solution after the substrate has been immersed in the acidic solution. The iron-based substrate may not be rinsed after immersion in the basic complexing solution to avoid reformation of iron oxides on the iron-based substrate.

In block 130, the iron-based substrate can be immersed in a catalytic metal solution including a dissolved catalytic metal. The catalytic metal solution can include palladium as the catalytic metal. The catalytic metal solution can be prepared using a soluble palladium salt (e.g., $PdSO_4$, $PdCl_4$, etc.) and a 10% to 15% sulfuric acid solution, where the catalytic metal solution can have a palladium ion concentration in the range of about 25 ppm to about 75 ppm, or at least about 55 ppm. In various embodiments, the catalytic metal solution can have a palladium ion concentration in the range of about 55 ppm to about 100 ppm, although other concentrations are contemplated.

In one or more embodiments, the catalytic metal is not platinum, rhodium, or silver.

In one or more embodiments, the iron-based substrate can be immersed in the catalytic metal solution for a duration of at least about 2 minutes or longer. In various embodiments, the iron-based substrate can be immersed in the catalytic metal solution for a duration of about 2 minutes to about 10 minutes. The iron-based substrate can be immersed in the catalytic metal solution after being removed from the basic complexing solution, and before being immersed in an electroless nickel plating solution.

Without intending to be limited by theory, it is believed that palladium (Pd metal) deposited on the substrate surface activates the iron-based substrate surface and reacts with $NaH_2PO_4$ in the solution to form palladium hydride that provides a catalytic surface that can reduce the nickel in the electroless nickel plating solution. The palladium can deposit on the surface and accessible pores of the iron-based substrate to form up to a monolayer of palladium. The palladium can absorb hydrogen up to about 40% by volume of the palladium coating. Nickel and cobalt are also considered self-catalyzing, where nickel can absorb hydrogen up to about 30-35% by volume, and cobalt can absorb hydrogen up to about 20% by volume. The palladium ions can replace at least a portion of the Fe on the iron-based substrate surface.

In one or more embodiments, the substrate can be blown dry using air or $N_2$ to remove the remaining catalytic metal solution and/or water from a deionized water rinse.

In block 140, the iron-based substrate can be rinsed with deionized water (DI) for about 1 minute after being immersed in the catalytic metal solution, and before immersing the iron-based substrate in an electroless nickel plating solution. The DI rinse can remove excess palladium ions and sulfate ions from the iron-based substrate surface.

In one or more embodiments, the iron-based substrate may be blown dry using nitrogen gas or dry air.

In block 150, the iron-based substrate can be immersed in an electroless nickel plating solution, where the electroless nickel plating solution can be prepared using a hydrated nickel sulfate salt (e.g., $NiSO_4.2H_2O$) and sodium hypophosphite ($NaH_2PO_2$), dimethylamine borane (DMAB), or sodium borohydride ($NaBH_4$). The sodium hypophosphite, sodium borohydride, and/or DMAB can act as a reducing agent. In various embodiments, a complexing agent can be included in the electroless nickel plating solution to prevent precipitation, as would be known in the art.

In one or more embodiments, the electroless nickel plating solution can be maintained at a temperature in the range of about 20° C. (i.e., normal temperature and pressure (NIST-NTP) to about 95° C. The iron-based substrate can be immersed in an electroless nickel plating solution for a time period in the range of about 10 minutes to about 2 hours, or in the range of about 30 minutes to about 150 minutes, or about 1 hour, where the electroless nickel plating solution can be maintained at a temperature of the described ranges above for the entirety duration. The electroless nickel plating solution can have a pH in the range of about 2 to about 10, or about 7 to about 9. In various embodiments, immersion and plating can continue for a predetermined duration to achieve a predetermined electroless nickel plating thickness.

In various embodiments, the electroless nickel plating solution can be a commercially available electroless nickel plating solutions having a predetermined concentration in the range of about 5 g/L to about 100 g/L. The temperature of the electroless nickel plating solution can be adjusted in relation with the concentration of the electroless nickel plating solution, where a higher concentration solution can be plated at a lower temperature to avoid decomposition and side reactions.

In one or more embodiments, nickel plating can be formed on the iron-based substrate by the electroless nickel plating solution, where the nickel plating can have a phosphorus content in the range of about 1% to about 20%, about 2% to about 20%, in the range of about 2% to about 13%, or in the range of about 4% to about 10%.

In one or more embodiments, the iron-based substrate can be immersed in an electroless cobalt plating solution, where the electroless cobalt plating solution can be prepared using a hydrated cobalt sulfate salt (e.g., $CoSO_4.H_2O$) and sodium hypophosphite ($NaH_2PO_2$), dimethylamine borane (DMAB), or sodium borohydride ($NaBH_4$). The electroless cobalt plating solution can be maintained at a temperature in the range of about 20° C. (i.e., normal temperature and pressure (NIST-NTP) to about 95° C. The iron-based substrate can be immersed in an electroless cobalt plating solution for a time period in the range of about 10 minutes to about 2 hours, or in the range of about 30 minutes to about 150 minutes, or about 1 hour, where the electroless cobalt plating solution can be maintained at a temperature of the described ranges above for the entire duration. The electroless cobalt plating solution can have a pH in the range of about 2 to about 11, or about 7 to about 9, where the solution pH can be buffered (e.g., using tartrates, citrates, etc.). In various embodiments, immersion and plating can continue for a predetermined duration to achieve a predetermined electroless cobalt plating thickness. In various embodiments, the electroless cobalt plating solution can be a commercially available electroless cobalt plating solutions with predetermined concentrations.

In various embodiments, formation of the electroless nickel and/or cobalt plating can be conducted at lower temperatures to obtain columnar structures.

Figure 2:
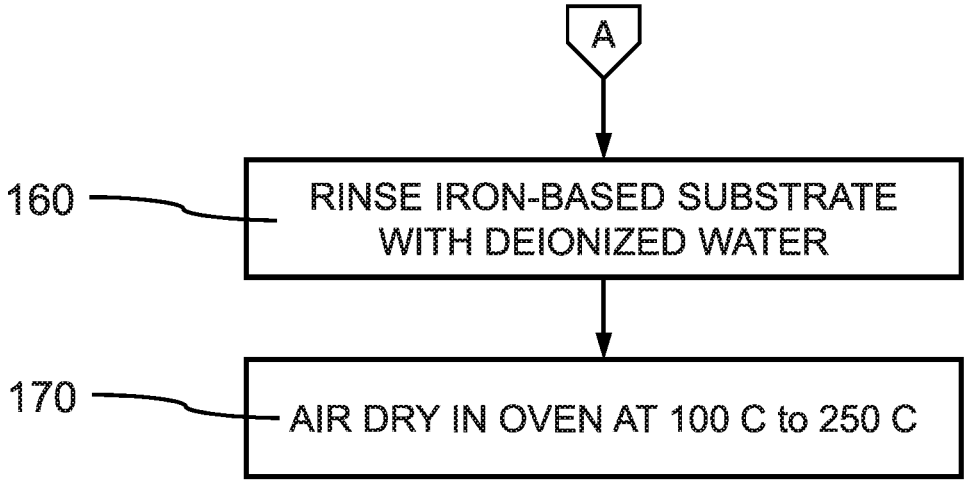
FIG. 2 is a continuation of the block/flow diagram of FIG. 1.

FIG. 2 is a continuation of the block/flow diagram of FIG. 1.

In block 160, the electroless nickel plated substrate or electroless cobalt plated substrate may be rinsed with deionized water.

In block 170, the nickel plating or cobalt may be heat treated after being removed from the electroless plating solution. The heat treatment can modify the mechanical, chemical, magnetic, and/or electrical properties of the electroless nickel plating. Heat treatment can be conducted at a sufficient temperature to relieve mechanical stress in the electrodeposited layer. The heat treatment can be at a predetermined heat treatment temperature in the range of about 50° C. to about 250° C., in the range of about 50° C. to about 150° C., or in the range of about 100° C. to about 200° C. In various embodiments, the temperature of the heat treatment can be less than 300° C. Heat treatment can be done in an oven, which may be under house vacuum.

In various embodiments, the temperature of the electroless nickel plated iron-based substrate can be heated by gradually increasing the temperature from NTP to a predetermined heat treatment temperature at a rate of less than 5° C./min., or at a rate in the range of about 1° C./min. to about 5° C./min, or in the range of about 1° C./min. to about 2.5° C./min. The electroless nickel plated iron-based substrate can be maintained at the predetermined temperature for a duration in the range of about 5 minutes to about 60 minutes, or in the range of about 30 minutes to about 60 minutes, where higher temperature heat treatments can be for shorter durations, so as to provide the same thermal budget. The electroless nickel plated iron-based substrate can be gradually cooled from the predetermined heat treatment temperature to 20° C. (i.e., normal temperature and pressure (NIST-NTP) at a rate of less than 5° C./min., or at a rate in the range of about 1° C./min. to about 5° C./min, or in the range of about 1° C./min. to about 2.5° C./min, where the electroless nickel plated iron-based substrate may be cooled at the same rate as electroless nickel plated iron-based substrate was heated. The iron-based substrate can be heated at a rate that avoids pressure buildup of vapor from the solutions in pores of the iron-based substrate.

In various embodiments, the heat treatment can be conducted under a vacuum, where the vacuum can be house vacuum (e.g., 725 torr to about 500 torr).

In a non-limiting exemplary embodiments, an iron-based substrate with a nickel-boron electroless plating can be heat treated at 250° C. for a duration of about 5 minutes to about 10 minutes.

The electroless nickel plated substrate may be rinsed prior to heat treatment.

Figure 3:
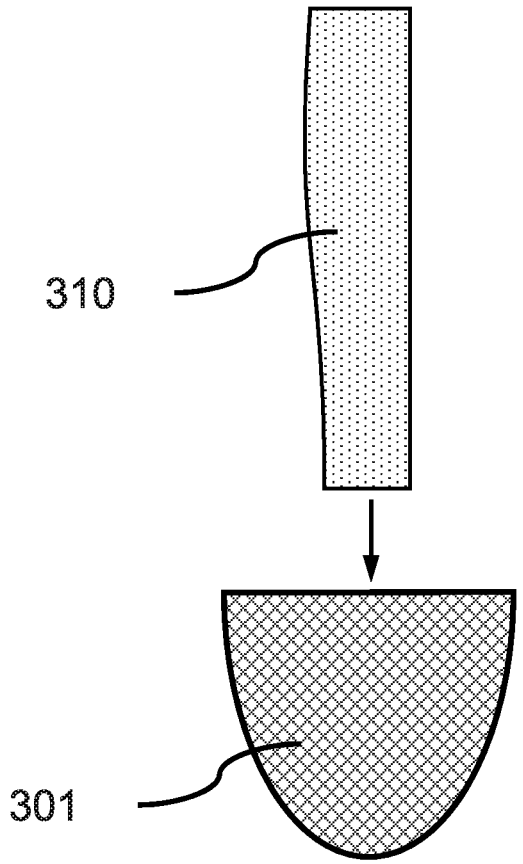
FIG. 3 is a diagram of an iron-based substrate being immersed in an acid solution to remove oxides from the surface, in accordance with an embodiment of the present invention.

FIG. 3 is a diagram of an iron-based substrate being immersed in an acid solution to remove oxides from the surface, in accordance with an embodiment of the present invention.

In one or more embodiments, the iron-based substrate 310 can be immersed in a tank, tub, or trough of the acidic solution (e.g., HCl) to remove oxides formed on the surface and in pores open to the surface to prepare the substrate for the deposition of a catalytic metal and electroless plating. The tank, tub, bath, or trough can be of sufficient size to submerge one or more substrates at the same time.

Figure 4:
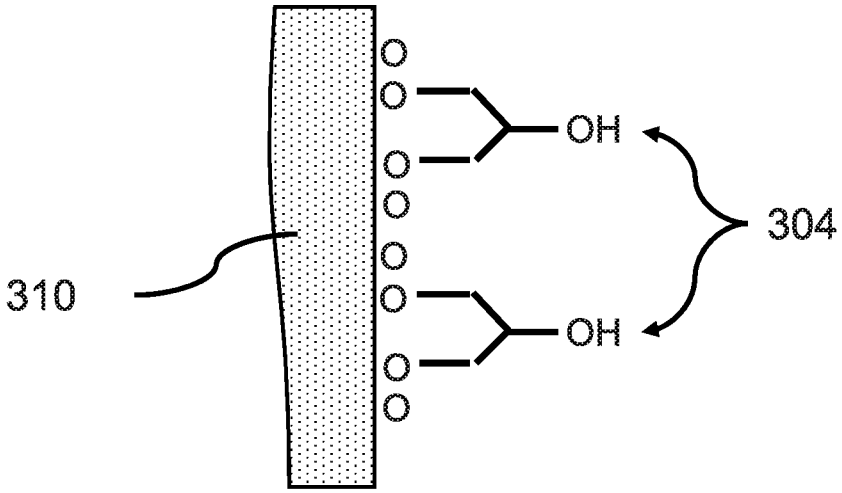
FIG. 4 is an illustration of complexing molecules attached to the surface of the iron-based substrate, in accordance with an embodiment of the present invention.

FIG. 4 is an illustration of complexing molecules attached to the surface of the iron-based substrate, in accordance with an embodiment of the present invention.

In one or more embodiments, the iron-based substrate 310 can be immersed in a basic complexing solution (i.e., pH above 7) containing complexing agents to prevent reformation of oxides on the surface of the substrate, where the complexing agents can bind to exposed iron (Fe) at the surface and in pores open to the surface. The complexing agent(s) 304 can prevent free oxygen from reforming the iron oxides (e.g., $Fe_2O_3$) before the catalytic metal is deposited on the surface.

Figure 5:
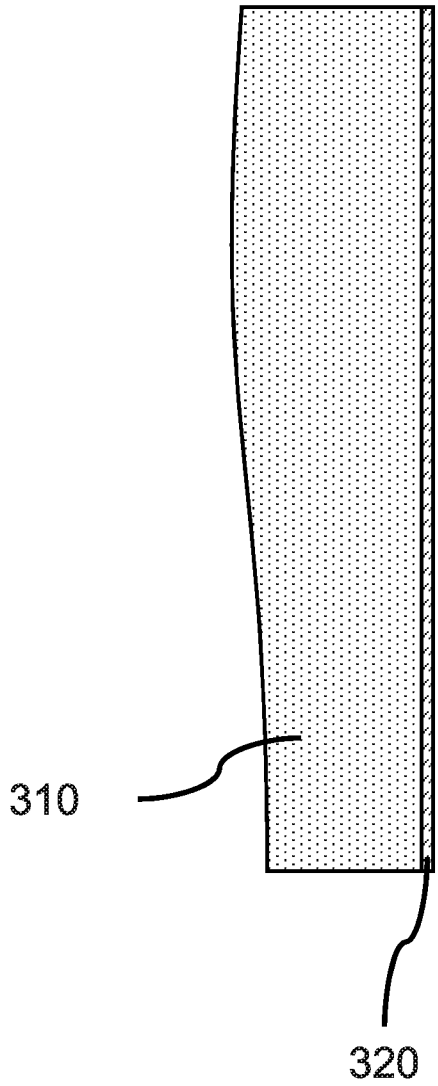
FIG. 5 is a side view of a monolayer of catalytic metal formed on an iron-based substrate, in accordance with an embodiment of the present invention.

FIG. 5 is a side view of a monolayer of catalytic metal formed on an iron-based substrate, in accordance with an embodiment of the present invention.

In one or more embodiments, the iron-based substrate 310 can be immersed in a tank, tub, or trough of the catalytic metal solution (e.g., Pd) to form up to a monolayer of the catalytic metal on the surface and in pores open to the surface.

Figure 6:
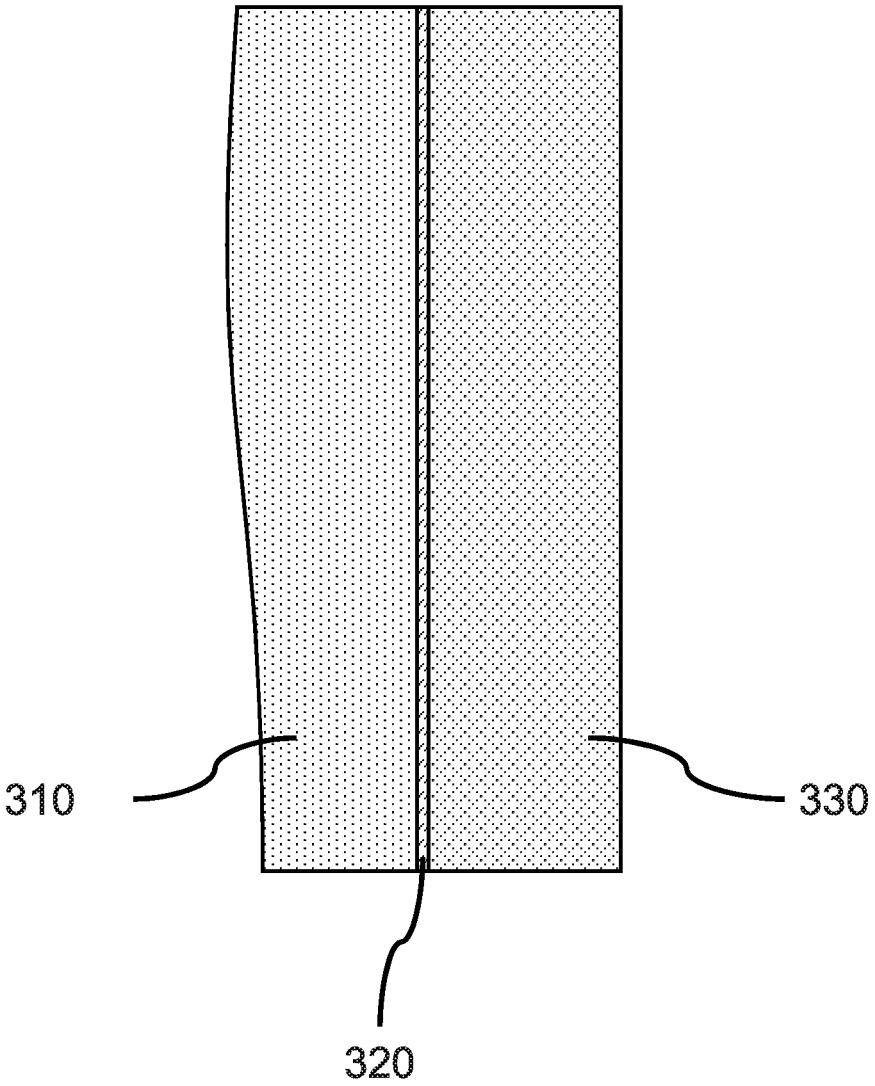
FIG. 6 is a side view of an electroless nickel or cobalt plating on a monolayer of catalytic metal formed on an iron-based substrate, in accordance with an embodiment of the present invention.

FIG. 6 is a side view of an electroless nickel or cobalt plating on a monolayer of catalytic metal formed on an iron-based substrate.

In one or more embodiments, up to a monolayer of the catalytic metal may be deposited on the surface and in pores open to the exposed surface of the iron-based substrate 310, where the catalytic metal can be palladium deposited on the surfaces from a catalytic metal solution. The electroless plating layer 330 (e.g., nickel or cobalt) can be deposited on the catalytic metal layer 320, where the electroless plating layer 330 can be deposited up to an intended thickness on the substrate.

Figure 7:
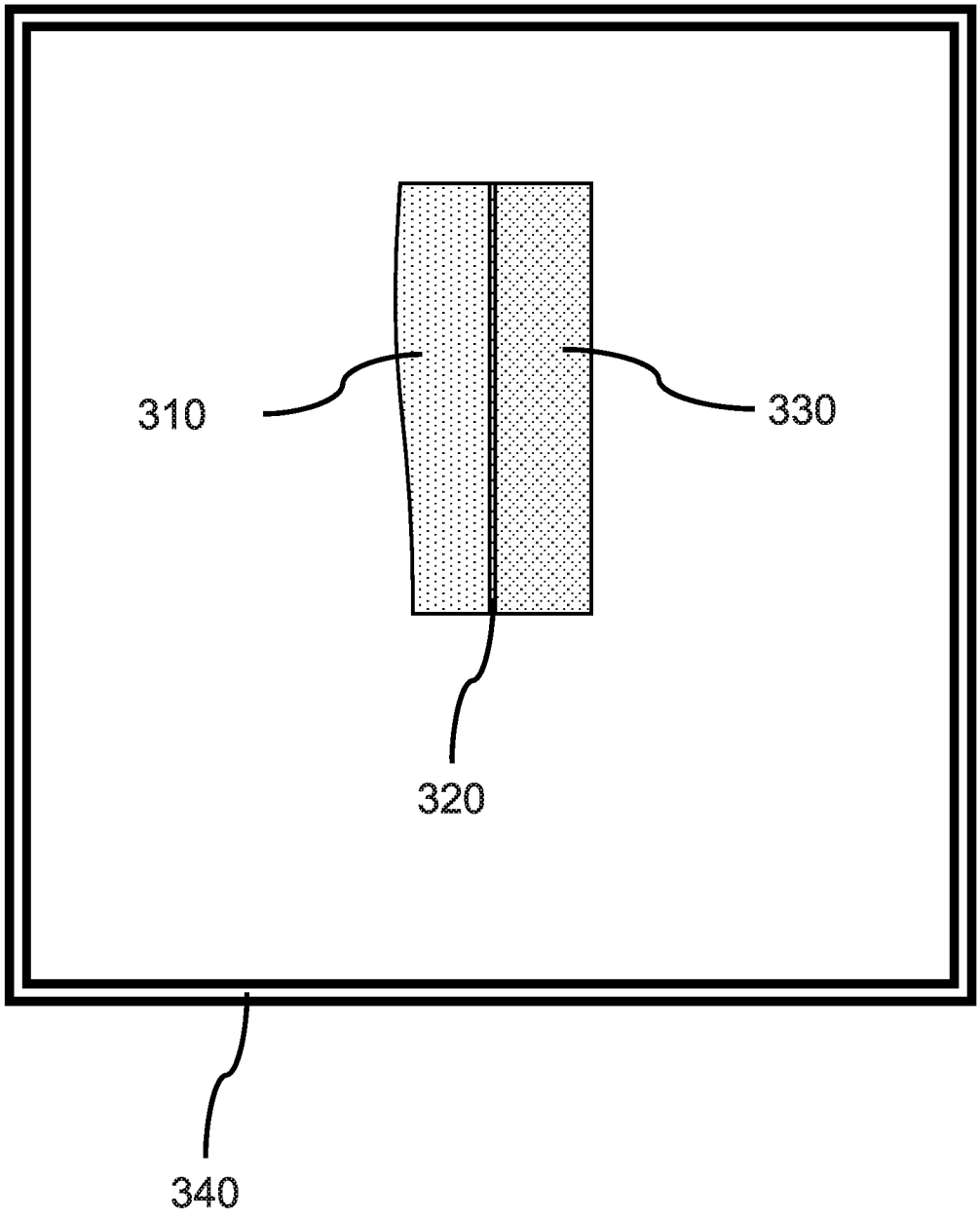
FIG. 7 is an illustration of an electroless plated iron-based substrate being heat treated in an oven, in accordance with an embodiment of the present invention.

FIG. 7 is an illustration of an electroless plated iron-based substrate being heat treated in an oven, in accordance with an embodiment of the present invention.

In one or more embodiments, the electroless plated, iron-based substrate may be heat treated (e.g., annealed) after being removed from the electroless plating solution. The heat treatment can modify the mechanical, chemical, magnetic, and/or electrical properties of the electroless plating (e.g., Ni, Co), where the heat treatment can be conducted at a sufficient temperature to relieve mechanical stress in the deposited layers. The heat treatment can be at a predetermined temperature in the range of about 50° C. to about 250° C., in the range of about 50° C. to about 150° C., or in the range of about 100° C. to about 200° C. In various embodiments, the temperature of the heat treatment can be less than 300° C. but above room temperature (i.e., NTP=20° C., 1 atm). Heat treatment can be done in an oven 340, which may be under house or low vacuum (e.g., between 760 Torr and 10 Torr).

It will be understood that, although the terms first, second, etc. may be used herein to describe various elements, these elements should not be limited by these terms. These terms are only used to distinguish one element from another element. Reference to first, second, third, etc., feature is intended to distinguish features without necessarily implying a particular order unless otherwise so stated or indicated. Thus, a first element discussed herein could be termed a second element without departing from the scope of the present concept.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Having described preferred embodiments of a method (which is intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A method of electrolessly plating a cast iron substrate, comprising:

immersing the cast iron substrate in an acidic solution;

immersing the cast iron substrate subsequently in a basic complexing solution containing sodium potassium tartrate ($KNaC_4H_4O_6$) or sodium citrate ($Na_3C_6H_5O_7$) having a concentration in the range of about 30 g/L to about 100 g/L that prevents reformation of oxides on the surface of the substrate after immersing the cast iron substrate in the acidic solution;

immersing the cast iron substrate directly in a catalytic metal solution including a catalytic metal without rinsing the cast iron substrate after immersing the cast iron substrate in the basic complexing solution; and immersing the cast iron substrate subsequently in an electroless nickel plating solution or an electroless cobalt plating solution.

2. The method of claim 1, wherein the acidic solution is a hydrochloric acid solution.

3. The method of claim 2, wherein the hydrochloric acid solution has a concentration in the range of about 5% to about 20% by weight hydrochloric acid.

4. The method of claim 3, wherein the hydrochloric acid solution is a 10% hydrochloric acid solution by weight.

5. The method of claim 1, wherein the basic complexing solution is a potassium sodium tartrate solution or sodium citrate solution with a pH in the range of above 7 to about 9.

6. The method of claim 5, further comprising maintaining the pH of the potassium sodium tartrate solution or sodium citrate solution at a pH of about 8 with a 2 molar sodium hydroxide solution or a hydrochloric acid solution to prevent re-oxidation.

7. The method of claim 1, wherein the catalytic metal is palladium.

8. The method of claim 7, wherein the catalytic metal solution contains 55 ppm Pd from dissolved $PdSO_4$ and a sulfuric acid solution.

9. The method of claim 1, further comprising rinsing the cast iron substrate with deionized water after immersion in the catalytic metal solution.

10. The method of claim 1, wherein the electroless nickel plating solution is used and includes a hydrated nickel sulfate salt, and sodium hypophosphite ($NaH_2PO_2$), dimethylamine borane (DMAB), or sodium borohydride ($NaBH_4$).

11. A method of nickel plating a cast iron substrate, comprising:

immersing the cast iron substrate, wherein the cast iron substrate does not form a protective oxide coating, in a 10% by weight hydrochloric acidic solution;

immersing the cast iron substrate subsequently in a basic complexing solution containing sodium potassium tartrate ($KNaC_4H_4O_6$) or sodium citrate ($Na_3C_6H_5O_7$) with a pH of about 8 and having a concentration in the range of about 30 g/L to about 100 g/L of the sodium potassium tartrate or sodium citrate for about 5 minutes to about 10 minutes that prevents reformation of oxides on the surface of and—the substrate after immersing the cast iron substrate in the acidic solution—is inserted in its place;

immersing the cast iron substrate subsequently in a catalytic metal solution including dissolved $PdSO_4$ and a sulfuric acid solution without rinsing the cast iron substrate after immersing the cast iron substrate in the basic complexing solution, wherein the catalytic metal solution forms up to a monolayer of palladium on the cast iron substrate surface; and immersing the cast iron substrate subsequently in an electroless nickel plating solution prepared using a nickel sulfate salt and sodium hypophosphite ($NaH_2PO_2$).

12. The method of claim 11, further comprising subsequently rinsing the cast iron substrate in deionized water after immersion in the catalytic metal solution.

13. The method of claim 12, wherein the cast iron substrate is immersed in the electroless nickel plating solution for about 1 hour, where the electroless nickel plating solution is maintained at a temperature of about 95° C. for the 1 hour.

14. The method of claim 11, wherein the cast iron substrate is immersed in the catalytic metal solution for a duration of about 2 minutes.

15. The method of claim 11, wherein the cast iron substrate is immersed in the 10% by weight hydrochloric acidic solution for a duration of about 5 minutes.

16. A method of nickel plating a cast iron substrate, comprising:

immersing an cast iron substrate in a 10% by weight hydrochloric acidic solution, wherein the cast iron substrate does not form a protective oxide coating;

immersing the cast iron substrate subsequently in a potassium sodium tartrate solution with a pH of about 8 and a concentration in the range of about 30 g/L to about 100 g/L of the potassium sodium tartrate;

immersing the cast iron substrate subsequently directly in a catalytic metal solution including about 25 ppm to about 75 ppm Pd from dissolved $PdSO_4$ and a sulfuric acid solution without rinsing the cast iron substrate after immersing the cast iron substrate in the potassium sodium tartrate solution, wherein the catalytic metal solution forms up to a monolayer of palladium directly on the cast iron substrate surface without using a nickel strike coating or silver as the catalytic metal; and immersing the cast iron substrate in subsequently an electroless nickel plating solution at a temperature in the range of about 20° C. to about 95° C., where the electroless nickel plating solution is prepared using a hydrated nickel sulfate salt ($NiSO_4$) and sodium hypophosphite ($NaH_2PO_2$), dimethylamine borane (DMAB), or sodium borohydride ($NaBH_4$).

17. The method of claim 16, further comprising rinsing the cast iron substrate with deionized water after immersion in the catalytic metal solution and before immersing the cast iron substrate in an electroless nickel plating solution.

18. The method of claim 16, wherein nickel plating is formed on the cast iron substrate by the electroless nickel plating solution, and the nickel plating has a phosphorus content of about 1 weight % to about 20 weight %.

19. The method of claim 18, further comprising heat treating the nickel plating.

* * * * *